US006357400B1

(12) United States Patent
Bedwell et al.

(10) Patent No.: US 6,357,400 B1
(45) Date of Patent: Mar. 19, 2002

(54) PISTON SLEEVE

(75) Inventors: Tommy J. Bedwell; Carmo Ribeiro, both of Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/520,111

(22) Filed: Mar. 7, 2000

(51) Int. Cl.[7] ..... F02F 1/10
(52) U.S. Cl. ..... 123/41.84; 123/41.81
(58) Field of Search ..... 123/41.81, 41.84, 123/193.2, 41.72, 41.74, 41.83; 29/888.06

(56) References Cited

U.S. PATENT DOCUMENTS

| | | | | |
|---|---|---|---|---|
| 2,283,424 A | | 5/1942 | Colwell et al. | |
| 2,387,971 A | | 10/1945 | Aspin et al. | |
| 4,127,058 A | | 11/1978 | Rohrle | |
| 4,221,196 A | | 9/1980 | Castarede | |
| 4,244,330 A | | 1/1981 | Baugh et al. | |
| 4,385,595 A | | 5/1983 | Shaw | |
| 4,399,783 A | | 8/1983 | Hauser, Jr. | |
| 4,562,799 A | | 1/1986 | Woods et al. | |
| 4,905,642 A | | 3/1990 | Suzuki et al. | |
| 4,926,801 A | | 5/1990 | Eisenberg et al. | |
| 4,986,230 A | | 1/1991 | Panyard et al. | |
| 5,209,197 A | | 5/1993 | Melchior | |
| 5,251,579 A | * | 10/1993 | Morris | 123/41.84 |
| 5,402,754 A | | 4/1995 | Gunnarsson | |
| 5,575,251 A | | 11/1996 | Bock | |
| 5,752,480 A | * | 5/1998 | Berggren et al. | 123/193.3 |
| 5,870,990 A | | 2/1999 | Sczepanski | |
| 5,979,374 A | * | 11/1999 | Jackson | 123/41.84 |
| 6,116,198 A | * | 9/2000 | Kirtley et al. | 123/41.84 |

* cited by examiner

*Primary Examiner*—Henry C. Yuen
*Assistant Examiner*—Hai Huynh
(74) *Attorney, Agent, or Firm*—Reising, Ethington, Barnes, Kisselle, Learman & McCulloch P.C.

(57) ABSTRACT

The piston sleeve has a radial positioning surface adjacent to the top surface and an axial positioning surface separated from radially positioning surface by a coolant contact surface. A piston bore extending the length of the piston sleeve is machined to form a non-cylindrical bore. The sleeve is compressed by applying force to the top surface and to the axial positioning surface. The piston sleeve is also heated to a normal working temperature. The compression force and the force due to thermal expansion deforms the piston sleeve and changes the non-cylindrical bore into a substantially cylindrical bore.

11 Claims, 3 Drawing Sheets

34
26
28
12
16
25
24
32
46
30
20
22
36
64
60
10
46
40
38
44
48
18
62
42

PRICR ART

PRICR ART

PISTON SLEEVE

This invention relates to a piston sleeve with a mid stop, for a high compression engine, and a contoured bore that becomes a cylindrical bore under operating conditions.

BACKGROUND OF THE INVENTION

Piston sleeves employed in high compression engines have generally had a flange on their top or head end that is clamped in place between the block and the cylinder head. The skirt of these piston sleeves is permitted to float due to thermal expansion and contraction. The elongation and contraction of piston sleeves that are dry has not been a problem. However cooling capacity must be somewhat larger with dry sleeves than with wet sleeves to insure adequate cooling.

High compression engines designed in recent years have generally had wet piston sleeves to improve cooling, reduce the coolant capacity requirement for their cooling systems and thereby reduce vehicle weight.

Piston sleeves with a top flange, as described above, that are in direct contact with engine coolant require sealing devices to seal between the sleeve skirt and the block. Such seals have durability problems. These durability problems are caused by movement between sleeve skirts and engine blocks due to thermal changes, engine vibrations, corrosion on the wet side of the sleeves, cavitation, seal material degeneration and other causes. Any leakage of coolant with antifreeze into an engine crankcase is a potential disaster. The water will be turned to vapor by crankcase heat and expelled from the crankcase. The antifreeze will not evaporate and therefore remains in the engine. Antifreeze is incompatible with engine lubrication systems and will cause moving parts to seize. Piston sleeve seal devices generally have a moderate failure rate during their first six thousand hours of operation or so. The seal device failure rate generally becomes unacceptable above ten thousand hours or so.

Engine designers are now designing engines with wet piston sleeves, each of which is anchored on the block by a radially extending flange that is mid way between the top end and the crankshaft or bottom end. The radially extending flange has an axial positioning surface in direct contact with a stop surface on the engine block. The sleeve is axially loaded between the cylinder head and the engine block stop surface to eliminate leakage of gasses and coolant. As a result, a seal device is not required between the block stop surface and the radially extending flange mid way between the sleeve ends. However, an appropriate seal device can also be employed if desired.

The axial load required to seal between a piston sleeve and the cylinder head and a block stop surface is substantial. The seal between the top end of the sleeve and the cylinder head must prevent the passage of compressed air prior to combustion and the pressure of hot gasses following combustion. In high output diesel engines that are turbocharged, the pressure in the combustion chamber is substantial. The seal between the axial positioning surface and the block stop surface generally does not require a large axial load. However, both seals must maintain a seal when the engine is cold as well as when the engine is hot.

The axial load on a piston sleeve with a mid stop that is required to prevent leakage between the top of a sleeve and a cylinder head and to prevent leakage between an axial positioning surface on the radial flange and a block stop surface under all possible operating conditions is large. An axial load on the piston sleeve that prevents leakage of gas and coolant, under a full range of operating conditions, distorts the inside walls of the piston sleeve. This distortion of the walls increases the rate of sleeve wall, piston and piston ring wear. The distortion also increases oil consumption, blow by, emissions of undesirable materials, and will eventually result in power loss. To minimize piston ring wear and all of the associated problems, the inside walls of the piston sleeves should be cylindrical or close to cylindrical under normal operating conditions.

One solution to the piston sleeve distortion problem has been proposed. This proposed solution is to provide thicker sleeve walls from the top edge to the mid stop. Thicker sleeve walls increases the weight of each sleeve and thereby increases the engine weight. A sleeve with an increased outside diameter requires a larger bore in the engine block. An increase in the diameter of the bores in the engine block will generally make it necessary to increase both the length and the width of the block to accommodate the larger bores for the piston sleeves and maintain coolant capacity. Increasing the block size obviously increases block weight and will generally make it necessary to increase the size and weight of other engine components.

SUMMARY OF THE INVENTION

The piston sleeve for a high compression internal combustion engine is a tubular member. The tubular member has a top surface, that is perpendicular to an axis of the tubular member, and a bottom surface. A radial positioning surface is adjacent to the top surface. An axial positioning surface faces axially toward the bottom surface and is between the top surface and the bottom surface. A radially outward facing coolant contact surface is between the radial positioning surface and the axial positioning surface. A skirt extends from the axial positioning surface to the bottom surface. A profiled radially inward facing surface extends substantially from the top surface to the bottom surface. The profile becomes substantially cylindrical when the piston sleeve is in a high compression internal combustion engine block and a predetermined axial compression force is applied to the top surface and to the axial positioning surface.

The piston sleeve provides a joint between its top surface and a cylinder head that holds products of combustion in the combustion chamber. Contact between the axial positioning surface of the piston sleeve and the engine block retains engine coolant and keeps coolant out of the crankcase without the use of a seal device. The cylindrical cylinder wall surface that is formed inside the sleeve during normal operation reduces piston ring wear, piston wear and sleeve wear. The cylindrical surface also reduces oil consumption blow by and undesirable emissions from the engine.

Piston sleeves for diesel engines with profiled cylinder walls as described above can be pressed into an internal combustion engine and ready to use as received from the factory. Expensive and time consuming honeing, polishing and cutting operations in the field are eliminated.

BRIEF DESCRIPTION OF THE DRAWING

These and other features and advantages of the present invention will become more readily appreciated when considered in connection with the following detailed description and appended drawings, wherein.

DETAILED DESCRIPTION OF THE PREFERRED EMBODIMENT

Figure 1:
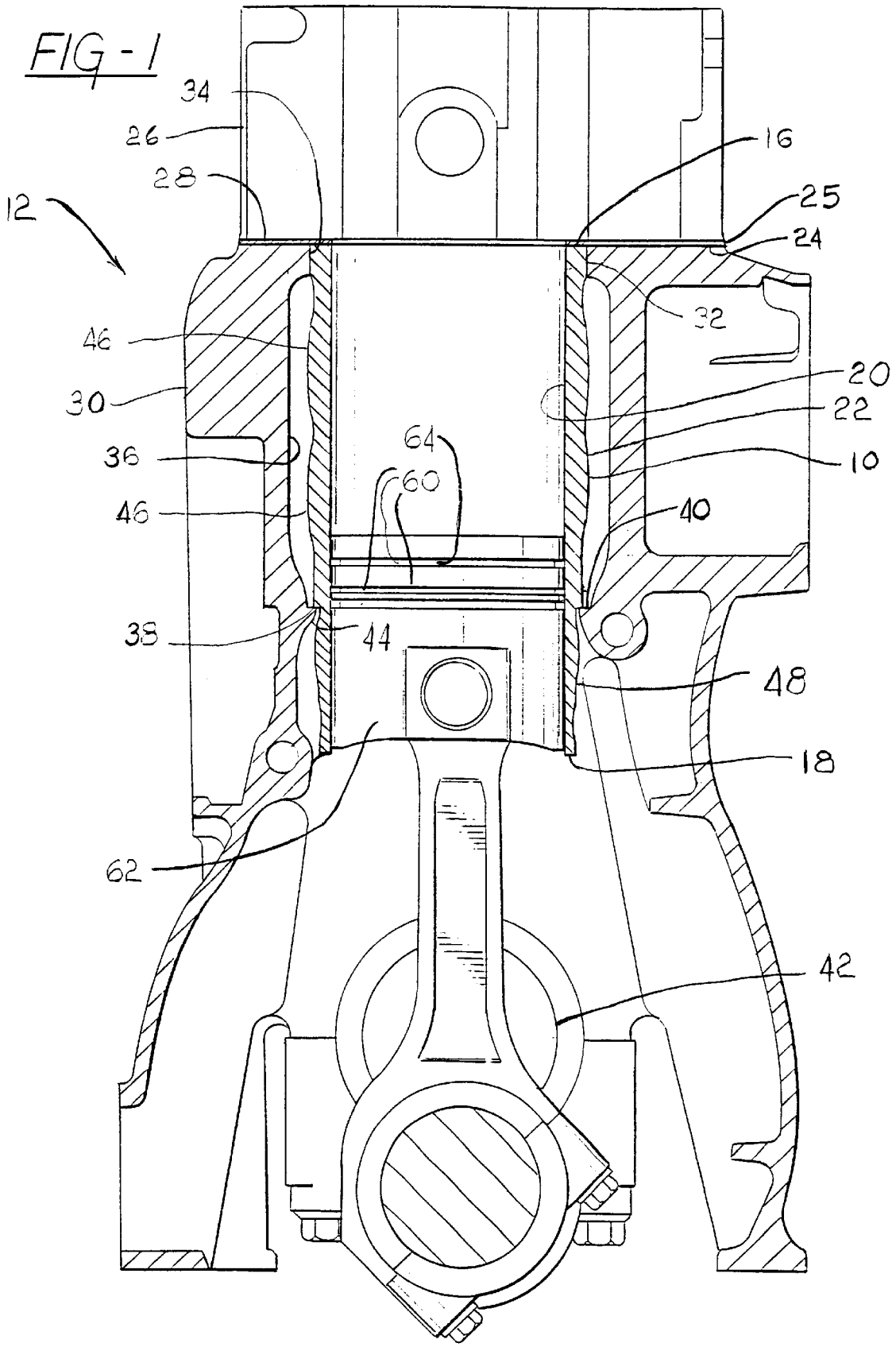
FIG. 1 is a sectional view of a piston sleeve mounted in an internal combustion engine.

A piston sleeve 10 for an internal combustion engine 12 is a tubular member with an axis 14. The sleeve 10 has a top surface 16, a bottom surface 18, a radially inner surface 20 and an outer surface 22. The top surface 16 is in a plane that is perpendicular to the axis 14. The bottom surface 18 is also in a plane that is perpendicular to the axis 14. The top surface 16 is separated from a surface 24 on the cylinder head 26 by a gasket 25. Normally the block top surface 28 of the engine block 30 is perpendicular to the axis 14 of the piston sleeve 10. It is convenient to have the sleeve top surface 16 in a plane that is parallel to the top surface 28 of the engine block 30. By placing the top surface 16 of the piston sleeve 10 in a plane that is perpendicular to the axis 14, force exerted on the sleeve by the cylinder head 26 is exerted in a direction that is parallel to the axis 14. There is no uneven force on the sleeve 10 that is transverse to the axis 14 and would tend to bend the sleeve. The bottom surface 18 is not in direct contact with any other object or surface. The bottom surface 18 of the sleeve 10 can be any shape within limits.

The outer surface 22 of the piston sleeve 10 has a radially positioning surface 32 adjacent to the top surface 16. This positioning surface 32 has a diameter that exceeds the diameter of the bore 34 in the internal combustion engine block 30. A press forces the radial positioning surface 32 into the bore 34 forming an interference fit that prevents leakage of coolant from the coolant jacket 36.

An axial positioning surface 38 on the piston sleeve 10 is between the top surface 16 and the bottom surface 18 and adjacent to the lower portion of the coolant jacket 36. As shown in the drawing, the axial positioning surface 38 is in a plane that is transverse to the axis 14. An engine block stop surface 40 is contacted by the axial positioning surface 38 and limits axial movement of the piston sleeve 10 toward the crankshaft 42. The engine block stop surface 40 is also in a plane that is transverse to the axis 14. The bore 44 in the block 30 provides clearance for the piston sleeve 10 thereby relying upon the bore 34 in the block to radially position the sleeve. Axial pressure on the top surface 16 of the sleeve 10 forces the axially positioning surface 38 into engagement with the block stop surface 40 and forms a coolant tight seal. If desired, a mechanical type seal device such an O ring could be employed. A mechanical seal device is not required however.

The axial positioning surface 38 and the block stop surface 40 could be conical mating surfaces that would fix the bottom surface 18 radially if desired. The diameter of the bore 44 could also be reduced to radially fix the bottom surface 18 if desired.

A coolant contact surface 46 extends from the radial positioning surface 32 to the axial positioning surface 38. Coolant in the coolant jacket 36 of an internal combustion engine 12 carries heat away from the coolant contact surface 46. A water pump (not shown) pumps coolant through the coolant jacket 36 and through a heat exchanger such as a radiator. The coolant contact surface 46 preferably has a diameter that is smaller than the diameter of the radial positioning surface 32 so that corrosion on the coolant contact surface does not prevent removal of a worn or damaged piston sleeve 10.

A skirt 48 extends axially from the axial positioning surface 38 to the bottom surface 18. The radially outer surface of the skirt 48 may be in contact with gasses and lubricant in the crankcase of the internal combustion engine 12. The outer diameter of the skirt 48 is smaller than other outer surfaces of the piston sleeve 10.

The reduced diameter of the skirt 48 reduces weight of the piston sleeve 10 and exposes the axial positioning surface 38. Loading on the skirt 48 is substantially less than loading on the sleeve 10 above the axial positioning surface 38. This reduced strength requirement permits the outside diameter of the skirt 48 to be reduced.

Clamping the cylinder head 26 to the engine block 30 places a substantial axial load on the piston sleeve 10. The load on the top surface 16 of the sleeve 10 is primarily a compressive load. Minor distortion of the inside or radially inner surface 20 of the piston sleeve 10 occurs near the top surface 16 and the axial positioning surface 38. This distortion causes the inside surface 20 to move radially inward near the top surface 16. The load exerted on the axial positioning surface 38 by the engine block stop surface 40 places bending loads on the piston sleeve 10 that warps the inside surface 20.

Figure 3:
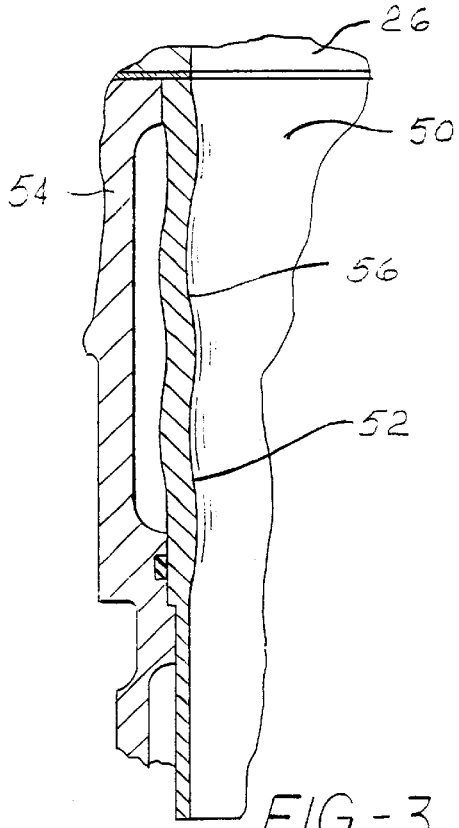
FIG. 3 is a sectional view of a prior art sleeve with a mid stop showing the inside wall profile when loaded and with parts broken away.
Figure 4:
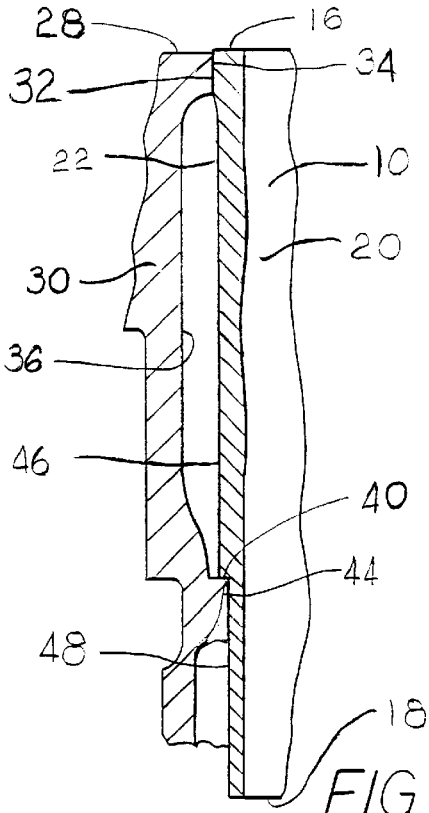
FIG. 4 is a sectional view with the piston sleeve mounted in an engine block but not axially loaded and with parts broken away.
Figure 5:
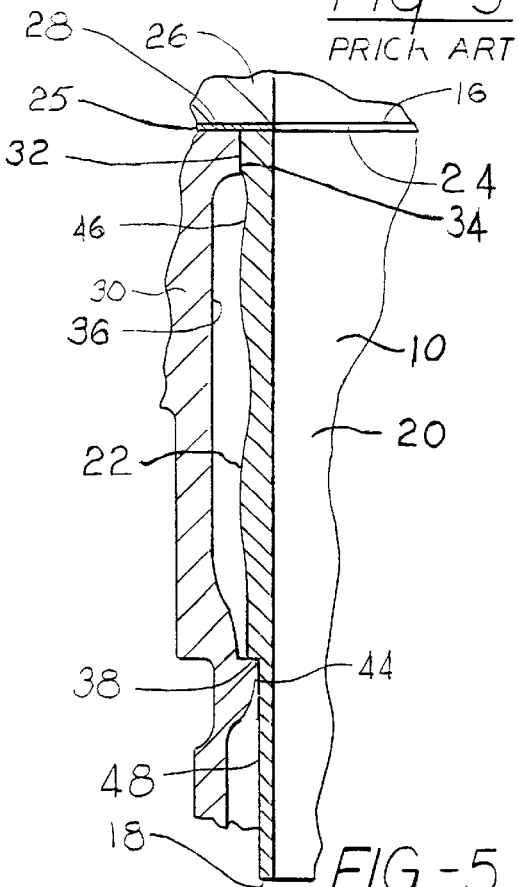
FIG. 5 is a sectional view with the piston sleeve mounted in an engine block, axially loaded and with parts broken away.

The prior art piston sleeve 50 shown in FIG. 3 has a substantially cylindrical surface 52 before a cylinder head 26 is clamped to the engine block 54. A wavy line 56 indicates the warpage (exaggerated) when the prior art sleeve 50 is clamped in place in a block 54.

The piston rings 60 on a piston 62 are radially compressed springs that tend to expand and follow the contour of the inside surface 20 of a sleeve 10. If the inside surface is warped as shown by the wavy line 56 in FIG. 3, a piston ring 60 is continuously expanding or contracting. This movement reduces the life of each ring 60 and wears the ring groove 64 in the piston 62. When the loaded piston sleeve 10 has a substantially cylindrical inside surface 20, the piston rings 60 have little change in diameter and wear is minimized.

Figure 6:
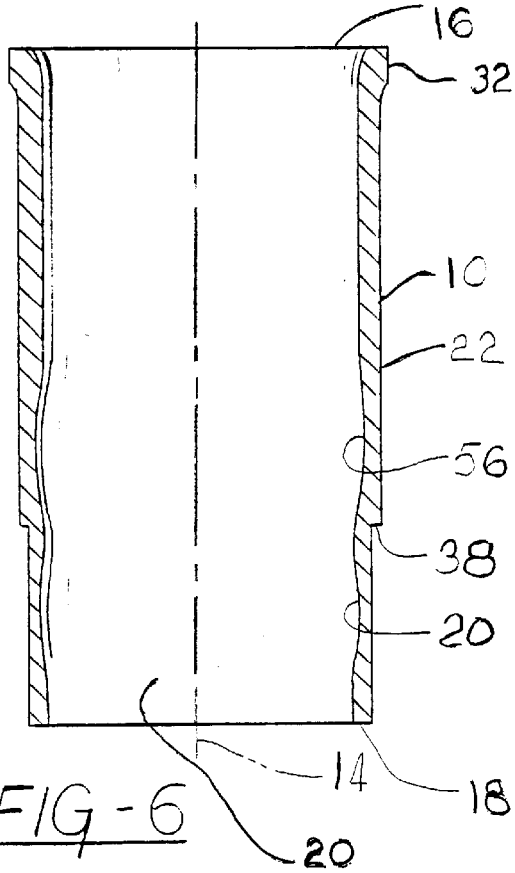
FIG. 6 is a vertical sectional view of the piston sleeve prior to axial loading.
Figure 7:
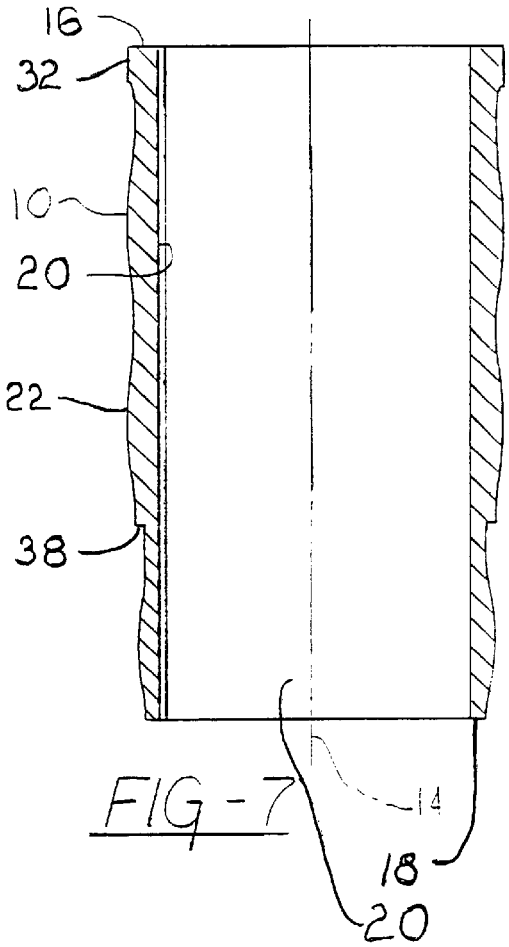
FIG. 7 is a view similar to FIG. 6 showing the sleeve axially loaded.

The unloaded piston sleeve 10 shown in FIG. 6 has been machined so that the inside surface 20 will be substantially cylindrical when axially loaded and running at the expected operating temperature. The unloaded profile is obtained by determining the quantities of material to be removed or added to change the warped profile 56 to a straight line. Removing and adding material changes the strength of the piston sleeve 10 where material is removed or added. The changes in strength requires modification of the final unloaded profile of the inner surface 20 of the piston sleeve 10.

Figure 2:
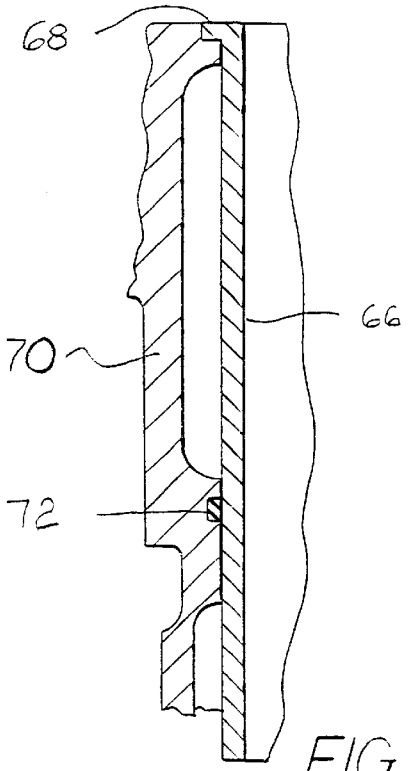
FIG. 2 is a sectional view of a prior art sleeve with a top flange that axially positions the sleeve in an internal combustion engine and with parts broken away.

The operating temperature of a piston sleeve will vary along the length of the sleeve from the top surface 16 to the bottom surface 18. The operating temperature will also vary depending upon ambient temperature, engine load and fuel characteristics. The profile of an inner surface 20 of the piston sleeve 10 is also modified to correspond to the expected operating temperature of the sleeve in an internal combustion engine 12. The inner surface 20 of a piston sleeve 10 in an internal combustion engine 12 that is operating at the expected temperature and engine load is substantially cylindrical as shown in FIG. 2. If there are changes in engine load, ambient temperature, or other operating conditions from the expected operating conditions, axial load on the piston sleeve 10 will change and the inner surface 20 will be slightly warped. However, large high compression engines 12 generally run in a relatively narrow temperature range. Expected changes in the inner surface 20 profile are generally small.

A piston sleeve 10 manufactured as set forth above can be mounted in an engine 12 and the engine can be assembled without additional machining, honeing or polishing of the piston sleeve.

The prior art piston sleeve 66, shown in FIG. 2 has a cylindrical rim 68. This cylindrical rim 68 axially fixes the sleeve 66 in the block 70. As explained above, with this arrangement there are essentially no axial loads on the sleeve 66. However, the sleeve 66 expands and contracts axially with temperature changes. To prevent leakage from the water jacket and accommodate axial movement of the sleeve 66 relative to the block 70, a seal 72 is provided. The seal 72 can accommodate the movement between the sleeve 66 and the block 70. However, seals 72 have a limited life. A diesel engine with a long life needs an improved sealing system as described above to eliminate the coolant leakage that may occur with seals 72 after a period of time.

Obviously, many modifications and variation of the present invention are possible in light of the above teachings. It is, therefore, to be understood that within the scope of the appended claims, the invention may be practiced otherwise than as specifically described. The invention is defined by the claims.

We claim:

1. A piston sleeve for a high compression internal combustion engine comprising:

a tubular member having a top surface, a tubular member axis, and a bottom surface;

a radial positioning surface adjacent to the top surface;

an axial positioning surface that faces axially toward the bottom surface and is between the top surface and the bottom surface;

a radially outward facing coolant contact surface between the radial positioning surface and the axial positioning surface;

a skirt extending from the axial positioning surface to the bottom surface; and a profiled radially inward facing surface extending substantially from the top surface to the bottom surface that becomes substantially cylindrical when the piston sleeve is mounted in the high compression internal combustion engine and a predetermined axial compression force is applied to the top surface and to the axial positioning surface.

2. A piston sleeve for a high compression internal combustion engine as set forth in claim 1 wherein an outside diameter of the skirt is less than an outside diameter of the axial positioning surface.

3. A piston sleeve for a high compression internal combustion engine as set forth in claim 1 wherein an outside diameter of the axial positioning surface is smaller than a diameter of the radial positioning surface.

4. A piston sleeve for a high compression internal combustion engine as set forth in claim 1 wherein an outside diameter of the radially outward facing coolant contact surface is less than a diameter of the radial positioning surface.

5. A piston sleeve for a high compression internal combustion engine as set forth in claim 1 wherein the top surface is in a plane that is perpendicular to the tubular member axis.

6. A piston sleeve for a high compression internal combustion engine as set forth in claim 1 wherein the radial positioning surface has a diameter that is larger than the diameter of a bore in an engine block that receives the piston sleeve.

7. A piston sleeve for a high compression internal combustion engine as set forth in claim 1 wherein the axial positioning surface is in a plane that is perpendicular to the tubular member axis.

8. A piston sleeve for a high compression internal combustion engine comprising:

a tubular member having an axis, a top surface in a plane that is perpendicular to the axis, and a bottom surface;

a radial positioning surface adjacent to the top surface having a positioning surface diameter that is larger than the bore diameter of the engine block bore that receives said piston sleeve;

an axial positioning surface that faces axially toward the bottom surface, that is in a positioning surface plane perpendicular to the axis, and is between the top surface and the bottom surface;

a radially outward facing coolant contact surface between the radial positioning surface and the axial positioning surface and having a coolant contact surface diameter that is less than the radial positioning surface diameter;

a skirt extending from the axial positioning surface to the bottom surface and having a skirt diameter that is less than a maximum diameter of the axial positioning surface; and a radially inward facing surface extending substantially from the top surface to the bottom surface that is machined to have a surface profile that becomes substantially cylindrical in response to axial force exerted on the top surface and the axial positioning surface.

9. A method of making a piston sleeve having a top surface, a bottom surface, an axial positioning surface and a coolant contact surface between the top surface and the axial positioning surface comprising the method steps of:

fixing the distance between the tops surface and the axial positioning surface to provide a required axial force on said piston sleeve to eliminate leaks past the top surface and past the axial positioning surface during use; and forming a profile on an inside surface of said piston sleeve which substantially corrects for distortion of the inside surface during use at a selected operating condition.

10. A piston sleeve for a high compression internal combustion engine comprising:

a tubular member having a top surface, a tubular member axis, and a bottom surface;

a radial positioning surface adjacent to the top surface;

an axial positioning surface that faces axially toward the bottom surface and is between the top surface and the bottom surface;

a radially outward facing coolant contact surface between the radial positioning surface and the axial positioning surface;

a skirt extending from the axial positioning surface to the bottom surface; and a profiled radially inward facing surface extending substantially from the top surface to the bottom surface that is non-cylindrically distorted when in a relaxed state but which becomes substantially cylindrical in response to mounting the piston sleeve in the high compression internal combustion engine under a predetermined axial compression force applied to the top surface and to the axial positioning surface.

11. A method of fabricating a piston sleeve for a high compression internal combustion engine, comprising:

preparing the sleeve having a top surface, a bottom surface, an axial positioning surface between the top and bottom surfaces, and a coolant contact surface between the top surface and the axial positioning surface;

forming a contour on a radially inwardly facing surface of the sleeve which is distorted when the sleeve is in an uncompressed relaxed state; and installing the sleeve in the engine by axially compressing the sleeve between the top surface and the axial positioning surface under such load that, during operation of the engine, the radially inner surface contour of the sleeve is caused to change shape to counteract the preformed distortion of the sleeve in said relaxed state.

* * * * *